US009199760B2

(12) United States Patent
Nagaoka et al.

(10) Patent No.: US 9,199,760 B2
(45) Date of Patent: Dec. 1, 2015

(54) FLAT BOTTLE

(71) Applicants: Atsushi Nagaoka, Tokyo (JP); Hiroki Oguchi, Tokyo (JP); Tetsuo Takahashi, Tokyo (JP)

(72) Inventors: Atsushi Nagaoka, Tokyo (JP); Hiroki Oguchi, Tokyo (JP); Tetsuo Takahashi, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 14/402,535

(22) PCT Filed: May 24, 2013

(86) PCT No.: PCT/JP2013/064483

§ 371 (c)(1),
(2) Date: Nov. 20, 2014

(87) PCT Pub. No.: WO2013/180032

PCT Pub. Date: Dec. 5, 2013

(65) Prior Publication Data

US 2015/0136726 A1 May 21, 2015

(30) Foreign Application Priority Data

May 31, 2012 (JP) ..... 2012-123961
Apr. 30, 2013 (JP) ..... 2013-095822

(51) Int. Cl.
*B65D 23/00* (2006.01)
*B65D 1/40* (2006.01)
(Continued)

(52) U.S. Cl.
CPC ..... *B65D 1/40* (2013.01); *B65D 1/0223* (2013.01); *B65D 1/0276* (2013.01); *B65D 2501/0081* (2013.01)

(58) Field of Classification Search
CPC ..... B65D 1/0261; B65D 1/0276; B65D 1/40; B65D 1/0223; B65D 1/2501; B65D 1/0081
USPC ..... 215/373, 371
See application file for complete search history.

(56) References Cited

U.S. PATENT DOCUMENTS 5,908,127 A * 6/1999 Weick et al. ..... 215/373
6,672,470 B2 * 1/2004 Wurster et al. ..... 215/373
(Continued)

FOREIGN PATENT DOCUMENTS

JP A-7-508959 10/1995
JP B2-2905838 6/1999
(Continued)

OTHER PUBLICATIONS

International Search Report issued in International Patent Application No. PCT/JP2013/064483 dated Jul. 30, 2013 (with translation).

*Primary Examiner* — Mickey Yu
*Assistant Examiner* — Niki Eloshway
(74) *Attorney, Agent, or Firm* — Oliff PLC

(57) ABSTRACT

The flat bottle includes a cylindrical body and a bottom closing a lower opening of the body, and is formed in a flattened shape in lateral cross-section having a major axis (La) and a minor axis (Sa). A bottom wall of the bottom includes a rising circumferential wall extending upward; an annular movable wall projecting inward from the rising circumferential wall in a bottle radial direction; and a recessed circumferential wall extending upward from the movable wall. The movable wall is movable around a connected portion with the rising circumferential wall. The length of the bottom along the major axis is 1.2 to 2.0 times the length of the bottom along the minor axis. The length of the movable wall along the major axis is 0.8 to 2.5 times the length of the movable wall along the minor axis.

4 Claims, 5 Drawing Sheets

(51) Int. Cl.
*B65D 1/02* (2006.01)
*B65D 90/02* (2006.01)

(56) References Cited

U.S. PATENT DOCUMENTS

| | | | | |
|---|---|---|---|---|
| 6,752,284 | B1 * | 6/2004 | Akiyama et al. | 215/379 |
| 7,017,763 | B2 | 3/2006 | Kelley | |
| 7,150,371 | B1 * | 12/2006 | Larson et al. | 215/373 |
| 7,451,886 | B2 * | 11/2008 | Lisch et al. | 215/373 |
| 7,882,971 | B2 * | 2/2011 | Kelley et al. | 215/373 |
| 8,739,994 | B1 * | 6/2014 | Pritchett et al. | 215/373 |
| 2006/0138074 | A1 * | 6/2006 | Melrose | 215/373 |
| 2007/0215571 | A1 * | 9/2007 | Trude | 215/373 |
| 2009/0159556 | A1 * | 6/2009 | Patcheak et al. | 215/373 |
| 2014/0374373 | A1 * | 12/2014 | Penet et al. | 215/373 |

FOREIGN PATENT DOCUMENTS

| | | |
|---|---|---|
| JP | A-2003-11944 | 1/2003 |
| JP | A-2008-539141 | 11/2008 |
| JP | A-2010-126184 | 6/2010 |
| WO | WO 94/11256 | 5/1994 |
| WO | WO 2006/118584 A1 | 11/2006 |

* cited by examiner

FIG. 4

| 1 | SHAPE DIAGRAM | h1 (mm) | L1 (mm) | S1 (mm) | L1/S1 | L2 (mm) | S2 (mm) | L2/S2 | RATIO OF MOVABLE WALL PORTION 2L2/L1 | RATIO OF MOVABLE WALL PORTION 2S2/S1 |
|---|---|---|---|---|---|---|---|---|---|---|
| 2 | | 2.75 | 75 | 62.5 | 1.2 | 13.2 | 16.5 | 0.8 | 0.4 | 0.5 |
| 3 | | 2.75 | 75 | 62.5 | 1.2 | 16.5 | 16.5 | 1.0 | 0.4 | 0.5 |
| 4 | | 2 | 82 | 58.1 | 1.41 | 6.1 | 18.1 | 0.3 | 0.1 | 0.6 |
| 5 | | 2 | 82 | 58.1 | 1.41 | 18.1 | 18.1 | 1.0 | 0.4 | 0.6 |
| 6 | | 2 | 82 | 58.1 | 1.41 | 21.0 | 18.1 | 1.2 | 0.5 | 0.6 |
| 7 | | 2 | 82 | 58.1 | 1.41 | 24.0 | 18.1 | 1.3 | 0.6 | 0.6 |
| 8 | | 2 | 82 | 58.1 | 1.41 | 27.0 | 18.1 | 1.5 | 0.7 | 0.6 |
| 9 | | 2 | 82 | 58.1 | 1.41 | 30.0 | 18.1 | 1.7 | 0.7 | 0.6 |
| 10 | | 2 | 82 | 58.1 | 1.41 | 30.0 | 12.1 | 2.5 | 0.7 | 0.4 |
| 11 | | 2 | 82 | 58.1 | 1.41 | 12.1 | 12.1 | 1.0 | 0.3 | 0.4 |
| 12 | | 2 | 82 | 58.1 | 1.41 | 6.1 | 6.1 | 1.0 | 0.1 | 0.2 |
| 13 | | 2.75 | 82 | 58.1 | 1.41 | 6.1 | 18.1 | 0.3 | 0.1 | 0.6 |
| 14 | | 2.75 | 82 | 58.1 | 1.41 | 12.1 | 18.1 | 0.7 | 0.3 | 0.6 |
| 15 | | 2.75 | 82 | 58.1 | 1.41 | 18.1 | 18.1 | 1.0 | 0.4 | 0.6 |
| 16 | | 2.75 | 82 | 58.1 | 1.41 | 30.0 | 18.1 | 1.7 | 0.7 | 0.6 |
| 17 | | 2.75 | 82 | 58.1 | 1.41 | 30.0 | 12.1 | 2.5 | 0.7 | 0.4 |
| 18 | | 2.75 | 82 | 58.1 | 1.41 | 30.0 | 6.3 | 4.8 | 0.7 | 0.2 |
| 19 | | 2.75 | 82 | 58.1 | 1.41 | 30.0 | 6.1 | 5.0 | 0.7 | 0.2 |
| 20 | | 2.75 | 82 | 58.1 | 1.41 | 12.1 | 12.1 | 1.0 | 0.3 | 0.4 |
| 21 | | 2.75 | 82 | 58.1 | 1.41 | 6.1 | 6.1 | 1.0 | 0.1 | 0.2 |
| 22 | | 2 | 97.6 | 48.8 | 2 | 14.3 | 21.5 | 0.7 | 0.3 | 0.9 |
| 23 | | 2.75 | 97.6 | 48.8 | 2 | 35.7 | 7.9 | 4.5 | 0.7 | 0.3 |
| 24 | | 2.75 | 97.6 | 48.8 | 2 | 35.7 | 7.4 | 4.8 | 0.7 | 0.3 |

FIG. 5

| 1 | SHAPE DIAGRAM | AT COMPLETION OF MOVABLE WALL PORTION REVERSAL | | REVERSAL OF MOVABLE WALL PORTION (VISUAL TEST) |
|---|---|---|---|---|
| | | DEGREE OF PRESSURE REDUCTION (kPa) | ABSORPTION VOLUME (ml) | |
| 2 | | — | — | ◎ |
| 3 | | — | — | ◎ |
| 4 | | 9.5 | 5.9 | ○ |
| 5 | | 4 | 6.6 | ◎ |
| 6 | | 3.8 | 6.3 | ◎ |
| 7 | | 5 | 7.1 | ◎ |
| 8 | | 5.6 | 7.6 | ◎ |
| 9 | | 5.6 | 8 | ◎ |
| 10 | | 9.9 | 8.7 | ◎ |
| 11 | | 11.1 | 8.3 | ○ |
| 12 | | 38.6 | 10 | ○ |
| 13 | | 41.6 | 12 | ○ |
| 14 | | — | — | × |
| 15 | | 4.1 | 9.1 | ◎ |
| 16 | | 5.6 | 9.9 | ◎ |
| 17 | | 9.7 | 10.6 | ◎ |
| 18 | | — | — | × |
| 19 | | — | — | × |
| 20 | | 11.6 | 10.8 | ○ |
| 21 | | 41.6 | 12 | ○ |
| 22 | | — | — | × |
| 23 | | — | — | × |
| 24 | | — | — | × |

FLAT BOTTLE

TECHNICAL FIELD

The present invention relates to a flat bottle.

Priority is claimed on Japanese Patent Application No. 2012-123961, filed May 31, 2012, and on Japanese Patent Application No. 2013-095822, filed Apr. 30, 2013, the contents of which are incorporated herein by reference.

BACKGROUND ART

In the related art, as shown in, for example, Patent Document 1, a flat bottle is known which includes a cylindrical body portion and a bottom portion closing the lower opening section of the body portion, and which has a flattened shape in lateral cross-section having a major axis and a minor axis perpendicular to each other at a point on the bottle axis.

DOCUMENT OF RELATED ART

Patent Document

[Patent Document 1] Japanese Patent Granted Publication No. 2905838

SUMMARY OF INVENTION

Technical Problem

However, the flat bottle in the related art has room for improvement in the pressure reduction-absorbing property thereof.

The present invention was made in view of the above circumstances, and an object thereof is to provide a flat bottle with a improved pressure reduction-absorbing property.

Solution to Problem

A flat bottle of the present invention provided as a means for solving the above problems includes a cylindrical body portion and a bottom portion which closes a lower opening section of the body portion, and is formed in a flattened shape in lateral cross-section which has a major axis and a minor axis perpendicular to each other at a point on a bottle axis. A bottom wall portion of the bottom portion includes a grounding portion positioned at an outer circumferential edge of the bottom wall portion; a rising circumferential wall portion connected to an inside of the grounding portion in a bottle radial direction and extending upward; an annular movable wall portion projecting from an upper end part of the rising circumferential wall portion toward inside of the rising circumferential wall portion in the bottle radial direction; and a recessed circumferential wall portion extending upward from an inner end of the movable wall portion in the bottle radial direction. The movable wall portion is arranged to be movable around a connected portion between the movable wall portion and the rising circumferential wall portion so as to move the recessed circumferential wall portion upward. The length of the bottom portion along the major axis is 1.2 to 2.0 times the length of the bottom portion along the minor axis. In addition, the length of the movable wall portion along the major axis is 0.8 to 2.5 times the length of the movable wall portion along the minor axis.

In the present invention, the relationship between the length of the bottom portion along the major axis of the body portion and the length of the bottom portion along the minor axis of the body portion, and the relationship between the length of the movable wall portion along the major axis of the body portion and the length of the movable wall portion along the minor axis of the body portion are set in the above ranges. Therefore, it becomes possible to reliably move the movable wall portion of the bottom wall portion of the bottom portion having a lateral cross-sectional flattened shape around the connected portion between the movable wall portion and the rising circumferential wall portion so as to move the recessed circumferential wall portion upward. As a result, the pressure reduction-absorbing property of the flat bottle can be improved.

In detail, the length of the movable wall portion along the major axis of the body portion denotes a length obtained by subtracting the length between both ends of the recessed circumferential wall portion along the major axis of the body portion from the length between both ends of the movable wall portion along the major axis of the body portion. The length of the movable wall portion along the minor axis of the body portion denotes a length obtained by subtracting the length between both ends of the recessed circumferential wall portion along the minor axis of the body portion from the length between both ends of the movable wall portion along the minor axis of the body portion.

In contrast, if the length of the bottom portion along the major axis of the body portion exceeds 2.0 times the length of the bottom portion along the minor axis of the body portion, the rigidity of part of the bottom wall portion along the minor axis (part in the vicinity of the minor axis) extremely increases compared to that of part of the bottom wall portion along the major axis (part in the vicinity of the major axis), and it may become difficult to turn the movable wall portion of the bottom wall portion. On the other hand, in a case where lateral cross-sectional shapes of the body portion and of the bottom portion are similar to each other, if the length of the bottom portion along the major axis of the body portion is less than 1.2 times the length of the bottom portion along the minor axis of the body portion, the degrees of flattening of the lateral cross-sectional shapes decrease, and the gripping property of a bottle may deteriorate.

In addition, if the length of the movable wall portion along the major axis of the body portion is less than 0.8 times the length of the movable wall portion along the minor axis of the body portion, since the length of the movable wall portion along the major axis of the body portion shortens, the rigidity of part of the movable wall portion along the major axis (part in the vicinity of the major axis) may extremely increase, and it may become difficult to turn the movable wall portion. On the other hand, if the length of the movable wall portion along the major axis of the body portion exceeds 1.2 times the length of the movable wall portion along the minor axis of the body portion, stress due to pressure reduction is extremely concentrated on part of the movable wall portion along the minor axis (part in the vicinity of the minor axis), the stress is not spread on part of the movable wall portion along the major axis, and it may become difficult to uniformly turn and deform the minor axis side and the major axis side thereof. It is noted that the major axes of the bottom portion, of the bottom wall portion, and of the movable wall portion are axes extending in a direction parallel to the major axis of the body portion, and that the minor axes of the bottom portion, of the bottom wall portion, and of the movable wall portion are axes extending in a direction parallel to the minor axis of the body portion.

As in the present invention, if the length of the movable wall portion along the major axis of the body portion is 0.8 to 1.2 times the length of the movable wall portion along the minor axis of the body portion, stress is uniformly applied to part of the movable wall portion along the major axis and to part of the movable wall portion along the minor axis, and it becomes easy to uniformly turn the entire movable wall portion. This effect is further improved by setting the length of the movable wall portion along the major axis of the body portion to be close to the length of the movable wall portion along the minor axis of the body portion. Accordingly, the outer edge shape of the movable wall portion may be formed to be similar to the outer edge shape of the recessed circumferential wall portion.

In addition, even in a case where the length of the movable wall portion along the major axis of the body portion exceeds 1.2 times the length of the movable wall portion along the minor axis of the body portion, if the length of the movable wall portion along the major axis is 2.5 times or less of the length of the movable wall portion along the minor axis, although it may not be easy to uniformly turn and deform the movable wall portion compared to a case where the length of the movable wall portion along the major axis is 0.8 to 1.2 times the length of the movable wall portion along the minor axis, the movable wall portion can be relatively uniformly turned and deformed. On the other hand, if the length of the movable wall portion along the major axis of the body portion exceeds 2.5 times the length of the movable wall portion along the minor axis of the body portion, the turning deformation of the movable wall portion is scarcely performed. Accordingly, if the length of the movable wall portion along the major axis of the body portion is 0.8 to 2.5 times the length of the movable wall portion along the minor axis of the body portion, it is possible to properly absorb pressure reduction by the movable wall portion.

Consequently, according to the present invention, using the above settings of length, it is possible to reliably move the movable wall portion around the connected portion between the movable wall portion and the rising circumferential wall portion, and the pressure reduction-absorbing property can be improved.

In a flat bottle of the present invention, the movable wall portion may be provided sloping gradually downward as it approaches inward from outside of the movable wall portion in the bottle radial direction, and a distance in a bottle axial direction between an outer end and the inner end of the movable wall portion in the bottle radial direction may be 1 to 3 mm.

In this case, if the distance in the bottle axial direction between the outer end and the inner end of the movable wall portion in the bottle radial direction is 1 mm or more, the sufficient pressure reduction-absorbing property can be obtained. On the other hand, if the distance exceeds 3 mm, it may become difficult to reversely deform the movable wall portion (to move the movable wall portion around the connected portion between the movable wall portion and the rising circumferential wall portion).

In a flat bottle of the present invention, a ratio of the length of the movable wall portion along the major axis to the length of the bottom portion along the major axis may be 0.4 or more, and a ratio of the length of the movable wall portion along the minor axis to the length of the bottom portion along the minor axis may be 0.4 or more.

In this case, the movable wall portion can have the sufficient flexibility (the rigidity thereof can be prevented from extremely increasing), compared to a case where the ratio of the length of the movable wall portion along the major axis of the body portion to the length of the bottom portion along the major axis of the body portion is less than 0.4 or where the ratio of the length of the movable wall portion along the minor axis of the body portion to the length of the bottom portion along the minor axis of the body portion is less than 0.4. Therefore, it becomes easy to smoothly turn the movable wall portion, the pressure reduction-absorbing property can be obtained by the movable wall portion, and the deformation of the body portion or the like can be easily suppressed.

Effects of Invention

According to the present invention, the pressure reduction-absorbing property of a flat bottle can be improved.

BRIEF DESCRIPTION OF DRAWINGS

FIG. 4 is a table showing dimensional settings of flat bottles in experimental examples of the present invention.

FIG. 5 is a table showing experimental results of the experimental examples.

DESCRIPTION OF EMBODIMENTS

Hereinafter, a flat bottle 1 of an embodiment of the present invention is described with reference to the drawings.

Figure 1:
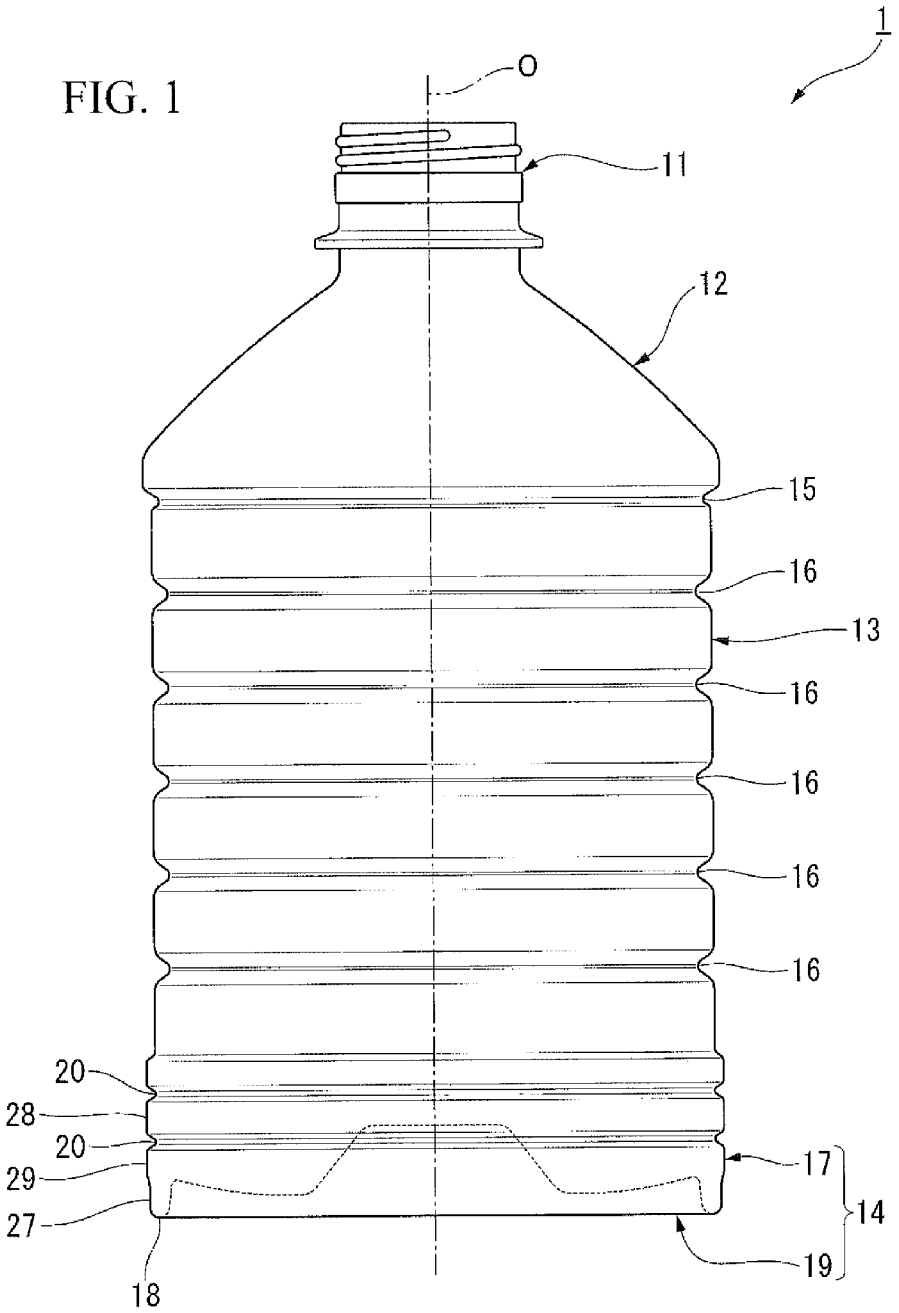
FIG. 1 is a side view of a flat bottle according to an embodiment of the present invention.

As shown in FIG. 1, the flat bottle 1 includes a mouth portion 11, a shoulder portion 12, a body portion 13, and a bottom portion 14. Each of the mouth portion 11, the shoulder portion 12, and the body portion 13 is formed in a cylindrical shape (or in an annular shape). The bottom portion 14 includes a portion formed in a cylindrical shape. In addition, the mouth portion 11, the shoulder portion 12, the body portion 13, and the bottom portion 14 are provided in series so as to dispose each central axis thereof on a common axis.

Hereinafter, the above common axis is referred to as a bottle axis O, a side in which the mouth portion 11 is provided in the bottle axis O direction is referred to as an upper side, and a side in which the bottom portion 14 is provided in the bottle axis O direction is referred to as a lower side. A direction perpendicular to the bottle axis O is referred to as a bottle radial direction, and a direction going around the bottle axis O is referred to as a bottle circumferential direction. The flat bottle 1 of this embodiment is made of synthetic resin materials and is formed by applying blow-molding to a preform which was formed in a cylindrical shape with a bottom through injection molding. A cap (not shown) is screwed to the mouth portion 11, and the cap may be attached through pressure (capping) to the mouth portion 11.

Figure 2:
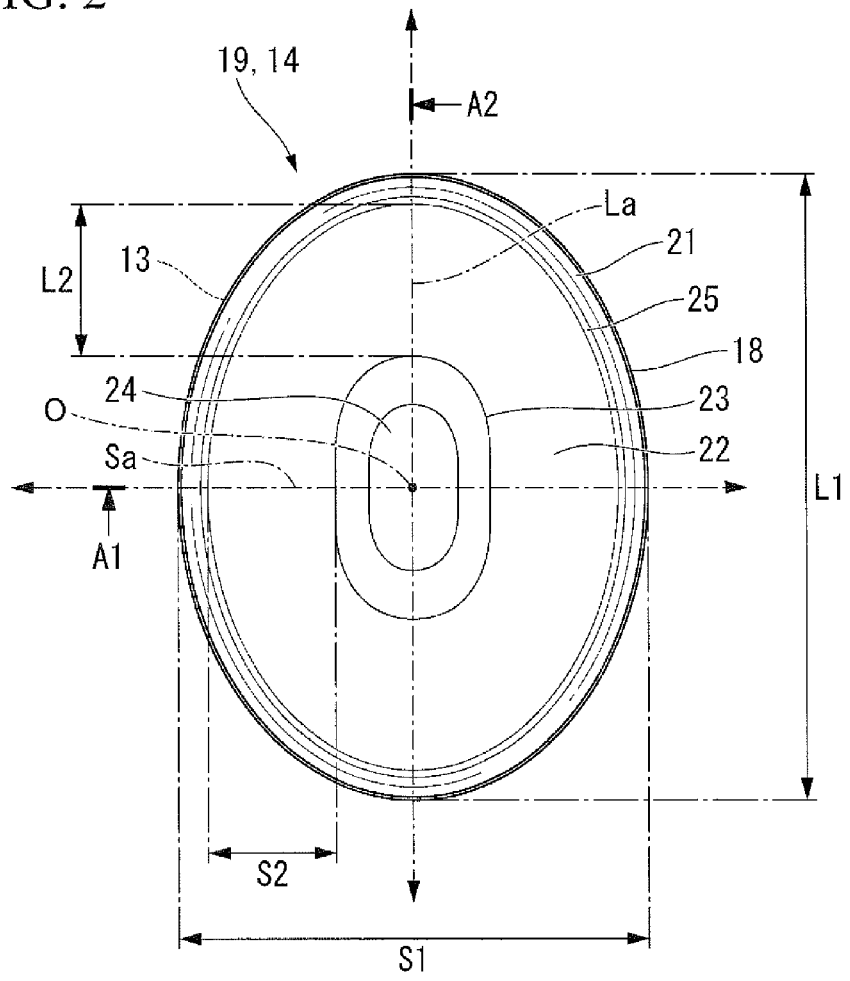
FIG. 2 is a bottom view of the flat bottle of this embodiment.

With reference to FIGS. 1 and 2, in this embodiment, in the mouth portion 11, the shoulder portion 12, the body portion 13, and the bottom portion 14, each of the shoulder portion 12, the body portion 13, and the bottom portion 14 is fainted in a flattened elliptical shape in lateral cross-section which has a major axis and a minor axis perpendicular to each other at a point on the bottle axis O. The major axis of the body portion 13 is particularly referred to as a major axis La, and the minor axis of the body portion 13 is particularly referred to as a minor axis Sa (additionally, the direction parallel to the major axis of the body portion 13 may be referred to as a major axis direction La, and the direction parallel to the minor axis of the body portion 13 may be referred to as a minor axis direction Sa). Each major axis of the shoulder portion 12 and the bottom portion 14 extends along the major axis La (in the major axis direction La), and each minor axis of the shoulder portion 12 and the bottom portion 14 extends along the minor axis Sa (in the minor axis direction Sa). That is, each lateral cross-sectional shape of the shoulder portion 12, the body portion 13, and the bottom portion 14 is an elliptical shape which is stretched in the same direction (the major axis direction La). In FIG. 2, each of the major axis La and the minor axis Sa is shown using a dashed-dotted line. The lateral cross-sectional shape of the mouth portion 11 is a precise circle.

A first annular groove 15 is formed in a portion between the shoulder portion 12 and the body portion 13, continuously on the entire circumference thereof. The body portion 13 is formed in a cylindrical shape and is formed having a smaller diameter than that of the lower end part of the shoulder portion 12 and of a heel portion 17 (described below) of the bottom portion 14. Second annular grooves 16 are formed in the body portion 13 at intervals in the bottle axis O direction. In FIG. 2, five second annular grooves 16 are formed at regular intervals in the bottle axis O direction. Each second annular groove 16 continuously extends over the entire circumference of the body portion 13.

The bottom portion 14 is formed in a cup shape which includes the heel portion 17 and a bottom wall portion 19. The heel portion 17 is formed in a cylindrical shape, and the upper opening section thereof is connected to the lower opening section of the body portion 13. The bottom wall portion 19 closes the lower opening section of the heel portion 17, and the outer circumferential edge of the bottom wall portion 19 constitutes a grounding portion 18.

A lower heel edge portion 27 of the heel portion 17, which is connected to the outside of the grounding portion 18 in the bottle radial direction, is formed having a smaller diameter than that of an upper heel portion 28 of the heel portion 17 which is connected to the lower end of the body portion 13. The upper heel portion 28 and the lower end part of the shoulder portion 12 have the largest outer diameter in the entire flat bottle 1.

A connection part 29 between the lower heel edge portion 27 and the upper heel portion 28 has a diameter which gradually decreases as it approaches downward from upper, and thereby the lower heel edge portion 27 has a smaller diameter than that of the upper heel portion 28. Third annular grooves 20 are formed in the upper heel portion 28 continuously on the entire circumference thereof, wherein the third annular groove 20 has approximately the same depth as that of, for example, the first annular groove 15. In FIG. 2, two third annular grooves 20 are formed with an interval in the bottle axis O direction.

Figure 3:
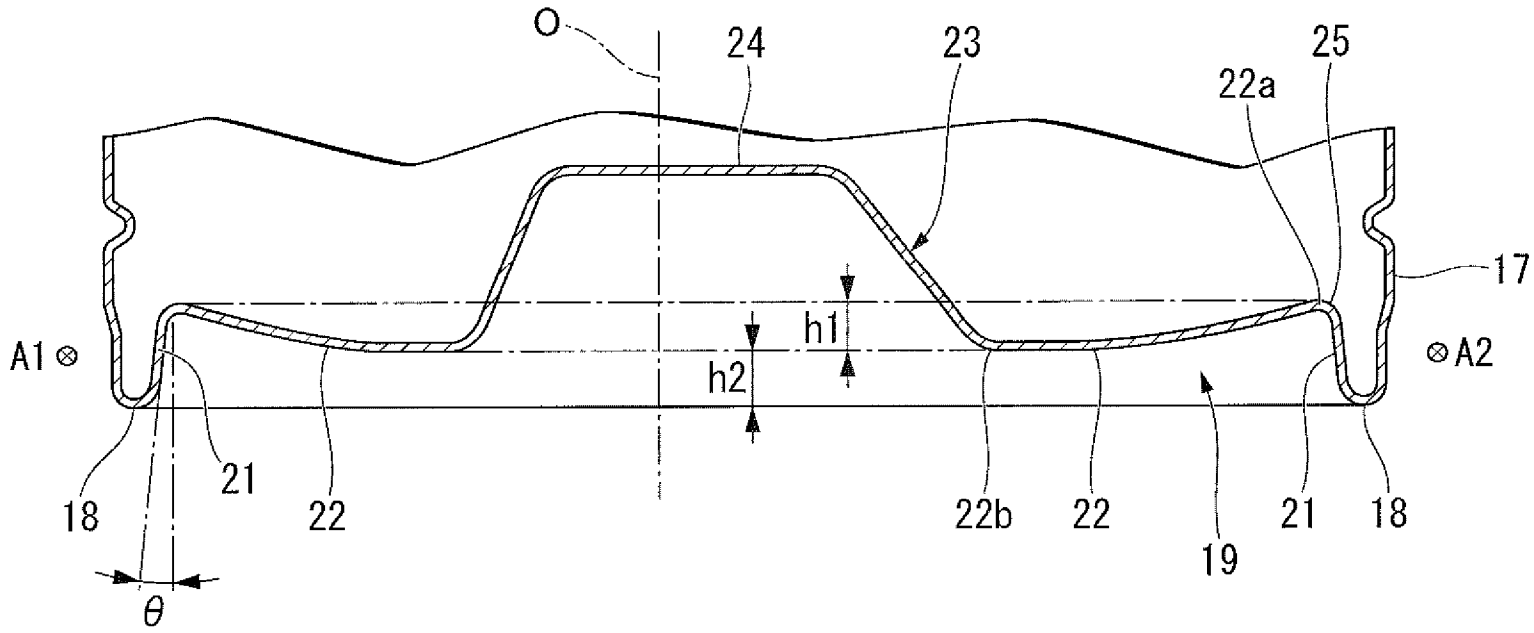
FIG. 3 is a development cross-sectional view along A1-A2 line in FIG. 2.

With reference to FIGS. 2 and 3, the bottom wall portion 19 includes the grounding portion 18, a rising circumferential wall portion 21 connected to the inside of the grounding portion 18 in the bottle radial direction and extending upward, a movable wall portion 22 projecting from the upper end part of the rising circumferential wall portion 21 toward inside of the rising circumferential wall portion 21 in the bottle radial direction, and a recessed circumferential wall portion 23 extending upward from the inner end of the movable wall portion 22 in the bottle radial direction.

The rising circumferential wall portion 21 has a diameter which gradually decreases as it approaches upward from below, and in detail, extends so as to incline gradually inward in the bottle radial direction as it approaches upward. The inclination angle θ between the rising circumferential wall portion 21 and the bottle axis O is, for example, about 10° or less in this embodiment.

The movable wall portion 22 is formed having a curved surface which projects downward and which has a relatively large curvature, and extends so as to slope gradually downward as it approaches inward from outside of the movable wall portion 22 in the bottle radial direction. The movable wall portion 22 is connected to the rising circumferential wall portion 21 through a curved surface part 25 projecting upward (having a convex shape). The movable wall portion 22 is configured to be capable of moving around the curved surface part 25 (around the connected portion between the movable wall portion 22 and the rising circumferential wall portion 21) so as to move the recessed circumferential wall portion 23 upward. In addition, the major axis of the movable wall portion 22 is an axis extending along the major axis La (in the major axis direction La), and the minor axis of the movable wall portion 22 is an axis extending along the minor axis Sa (in the minor axis direction Sa).

The recessed circumferential wall portion 23 is arranged coaxially with the bottle axis O, and is formed in an elliptical shape in lateral cross-section having a diameter which gradually increases as it approaches downward from upper. That is, similar to the body portion 13 or the like, the recessed circumferential wall portion 23 is also formed in a flattened shape in lateral cross-section which has a major axis and a minor axis perpendicular to each other at a point on the bottle axis O. The major axis of the recessed circumferential wall portion 23 is an axis extending along the major axis La (in the major axis direction La), and the minor axis of the recessed circumferential wall portion 23 is an axis extending along the minor axis Sa (in the minor axis direction Sa). A top wall 24, which has an elliptical plate shape arranged coaxially with the bottle axis O, is connected to the upper end part of the recessed circumferential wall portion 23, and the whole of the recessed circumferential wall portion 23 and the top wall 24 is formed in a cylindrical shape with a top.

As shown in FIG. 2, in the flat bottle 1, a length L1 of the bottom portion 14 along the major axis La (the length L1 in the major axis direction La) is set in the range of 1.2 to 2.0 times a length S1 of the bottom portion 14 along the minor axis Sa (the length S1 in the minor axis direction Sa), and for example, the lengths L1 and S1 are set to 90 and 66 mm, respectively. Additionally, in this embodiment, a length L2 of the movable wall portion 22 along the major axis La (the length L2 in the major axis direction La) is set to 0.8 to 1.2 times a length S2 of the movable wall portion 22 along the minor axis Sa (the length S2 in the minor axis direction Sa).

In detail, the length L2 of the movable wall portion 22 along the major axis La is obtained by dividing a value by 2, wherein the value is obtained by subtracting the length between both ends of the recessed circumferential wall portion 23 along the major axis La from the length between both ends of the movable wall portion 22 along the major axis La. The length S2 of the movable wall portion 22 along the minor axis Sa is obtained by dividing a value by 2, wherein the value is obtained by subtracting the length between both ends of the recessed circumferential wall portion 23 along the minor axis Sa from the length between both ends of the movable wall portion 22 along the minor axis Sa.

As shown in FIG. 3, a distance h1 in the bottle axis O direction between an outer end 22*a* and an inner end 22*b* of the movable wall portion 22 in the bottle radial direction is set in 1 to 3 mm. In addition, a distance h2 in the bottle axis O direction between the inner end 22*b* of the movable wall portion 22 and the grounding portion 18 is set to 2 mm or more. If the distance h2 between the inner end 22*b* and the grounding portion 18 is 2 mm or more, it is possible to prevent the movable wall portion 22 from contacting the supporting surface (mounting surface) at, for example, the time the flat bottle 1 is placed on the supporting surface.

In the flat bottle 1 configured as described above, when the internal pressure thereof is decreased, the movable wall portion 22 moves upward around the curved surface part 25 of the bottom wall portion 19, and thereby the movable wall portion 22 moves so as to raise the recessed circumferential wall portion 23 upward. That is, by actively deforming the bottom wall portion 19 of the flat bottle 1 at the time of pressure reduction, while the body portion 13 is prevented from being deformed, internal pressure change (pressure reduction) of the flat bottle 1 can be absorbed. Thereby, the predetermined pressure reduction-absorbing performance can be obtained.

In the flat bottle 1, the relationship between the length L1 of the bottom portion 14 along the major axis La and the length L2 of the bottom portion 14 along the minor axis Sa, the distance h1 in the bottle axis O direction between the outer end 22*a* and the inner end 22*b* of the movable wall portion 22 in the bottle radial direction, and the relationship between the length L2 of the movable wall portion 22 along the major axis La and the length S2 of the movable wall portion 22 along the minor axis Sa are set in the above ranges. Therefore, the movable wall portion 22 in the bottom wall portion 19 of the bottom portion 14 having a lateral cross-sectional flattened shape can be reliably moved around the connected portion (the curved surface part 25) between the movable wall portion 22 and the rising circumferential wall portion 21 so as to move the recessed circumferential wall portion 23 upward. As a result, the pressure reduction-absorbing property of the flat bottle can be improved.

In contrast, if the length L1 of the bottom portion 14 along the major axis La exceeds 2.0 times the length S1 of the bottom portion 14 along the minor axis Sa, the rigidity of part of the bottom wall portion 19 along the minor axis (part in the vicinity of the minor axis) extremely increases compared to that of part of the bottom wall portion 19 along the major axis (part in the vicinity of the major axis), and thus it may become difficult to turn the movable wall portion 22 of the bottom wall portion 19.

In addition, if the distance h1 in the bottle axial direction between the outer end 22*a* and the inner end 22*b* of the movable wall portion 22 in the bottle radial direction is 1 mm or more, the sufficient pressure reduction-absorbing property can be obtained. On the other hand, if the distance h1 exceeds 3 mm, it may become difficult to reversely deform the movable wall portion 22 (deformation in which the movable wall portion 22 becomes a shape which extends in the horizontal direction or which gradually slopes upward as it approaches inward from outside thereof in the radial direction). Therefore, if the distance in the bottle axis O direction between the outer end 22*a* and the inner end 22*b* of the movable wall portion 22 in the bottle radial direction is set in 1 to 3 mm, the pressure reduction-absorbing property of the flat bottle can be reliably improved.

Furthermore, if the length L2 of the movable wall portion 22 along the major axis La is less than 0.8 times the length S2 of the movable wall portion 22 along the minor axis Sa, the length L2 of the movable wall portion 22 along the major axis La shortens, the rigidity of part of the movable wall portion 22 along the major axis (part in the vicinity of the major axis) extremely increases, and it may become difficult to turn the movable wall portion 22. On the other hand, if the length L2 of the movable wall portion 22 along the major axis La exceeds 1.2 times the length S2 of the movable wall portion 22 along the minor axis Sa, since the difference between the lengths of the recessed circumferential wall portion 23 along the major axis La and along the minor axis Sa becomes slight and the recessed circumferential wall portion 23 becomes a shape close to a circle or the like, stress due to pressure reduction is extremely concentrated on part of the movable wall portion 22 along the minor axis (part in the vicinity of the minor axis), the stress is not spread on part of the movable wall portion 22 along the major axis (part in the vicinity of the major axis), and it may become difficult to uniformly turn and deform the minor axis side and the major axis side thereof.

That is, when stress due to pressure reduction is applied to the movable wall portion 22, the stress is approximately uniformly spread on the entire circumference thereof, and one part in the major axis direction of the movable wall portion firstly starts the turning deformation. Subsequently, it is conceivable that the turning deformation occurs in the other part in the major axis direction of the movable wall portion, and part in the minor axis direction of the movable wall portion, in sequence.

On the other hand, if the length L2 of the movable wall portion 22 along the major axis La is 0.8 to 1.2 times the length S2 of the movable wall portion 22 along the minor axis Sa, the stress is uniformly applied to part of the movable wall portion 22 along the major axis and to part of the movable wall portion 22 along the minor axis, and it becomes easy to uniformly turn the entire movable wall portion 22.

In addition, in this embodiment, the distance in the bottle axis O direction between the inner end 22*b* of the movable wall portion 22 in the bottle radial direction and the grounding portion 18 is set to 2 mm or more. In this case, for example, when contents are filled in the flat bottle 1, the inner end 22*b* of the movable wall portion 22 in the bottle radial direction can be prevented from being deformed so as to project lower than the grounding portion 18.

In addition, the technical scope of the present invention is not limited to the above embodiment, and various modifications can be adopted within the scope of and not departing from the gist of the present invention.

In the above embodiment, the inclination angle θ of the rising circumferential wall portion 21 is set to about 10° or less, but the present invention is not limited to this configuration. For example, it is preferable that the inclination angle θ be set to 3° or less.

In the above embodiment, each shape in lateral cross-section perpendicular to the bottle axis O of the shoulder portion 12, the body portion 13, the bottom portion 14, and the recessed circumferential wall portion 23 is an elliptical shape. However, each shape is not limited to an elliptical shape, and may be, for example, a rectangular shape, a shape obtained by removing both end parts in the major axis direction from an ellipse, or the like. In this case, the longitudinal direction parallel to the long side in a lateral cross-section means the major axis direction La, and the lateral direction parallel to the short side in the lateral cross-section means the minor axis direction Sa.

As synthetic resin materials forming the flat bottle 1, polyethylene terephthalate, polyethylene naphthalate, amorphous polyester or the like is suitably employed.

In the above embodiment, a bottle has a structure in which an annular groove is provided in the body portion 13. However, no annular groove may be provided, and various structures such as a longitudinal groove, a pressure reduction-absorbing panel, and a combination thereof can be applied to the body portion 13. In a case where a pressure reduction-absorbing functional unit such as a pressure reduction-absorbing panel or a pressure reduction-absorbing surface is provided in the body portion 13, larger pressure reduction-absorbing performance can be obtained by combining the pressure reduction-absorbing function of the bottom portion therewith.

Even in a case where any pressure reduction-absorbing functional unit is not provided on the body portion 13 in the above embodiment, by obtaining a desired pressure reduction-absorbing function using the bottom portion, the body portion 13 can be prevented from being deformed, and a good appearance of a bottle can be maintained even at the time of pressure reduction.

A bottle of the above embodiment may be configured so that not only a cap but also a dispenser such as a pump is attached thereto.

EXPERIMENTAL EXAMPLES

Hereinafter, experimental examples are described with reference to the tables shown in FIGS. 4 and 5, wherein bottles were prepared by applying dimensional settings based on the present invention and dimensional settings other than them to flat bottles having a structure in which a bottom portion includes a movable wall portion and a recessed circumferential wall portion described in the above embodiment, and after the internal pressure of a bottle was decreased, a visual test was performed in order to determine whether or not the movable wall portion properly moved at the time of pressure reduction, and the degree of pressure reduction and the absorption volume of a bottle at the time the movable wall portion precisely moved were measured.

FIG. 5 shows the results of the experimental examples. As shown in FIG. 5, in the experimental examples, it was evaluated whether or not the movable wall portion precisely moved, in three grades denoted by signs "double circles", "single circle" and "x-mark" through the visual test.

The sign "double circles" denotes a case where the movable wall portion smoothly moved upward on the entire circumference thereof in a state where the degree of pressure reduction was estimated to be low, the movable wall portion finally moved to the horizontal position, and the pressure reduction absorption was suitably performed by the movable wall portion. In addition, this sign denotes a case where visually significant deformation did not occur in the top part of the recessed circumferential wall portion inside the movable wall portion.

The sign "single circle" denotes a case where it was evaluated that the movable wall portion can move to the horizontal position if the degree of pressure reduction is increased, and denotes a case where although the pressure reduction absorption was performed by the movable wall portion, the movable wall portion did not smoothly move. In addition, this sign denotes a case where visually relatively large deformation occurred in the top part of the recessed circumferential wall portion inside the movable wall portion.

The sign "x-mark" denotes a case where the movable wall portion did not move so as to reach the horizontal position even if the degree of pressure reduction was increased.

A case of moving to the horizontal position means a case where the inner end part in the radial direction of the movable wall portion moved upward the distance h1 shown in FIG. 3 (or the distance h1 or more) (hereinafter, it may be referred to as height dimension).

"Degree of pressure reduction" means the amount of decreased pressure from the normal pressure (pressure before reduction) at the time the movable wall portion properly moved.

"Absorption volume" means the amount of decreased internal volume of a bottle at the time the movable wall portion properly moved.

In addition, the degree of pressure reduction when it is evaluated as the case denoted by the sign "double circles" through the visual test becomes lower than that when it is evaluated as the case denoted by the sign "single circle", if both absorption volumes are the same. In other words, when bottles evaluated as the cases denoted by the signs "double circles" and "single circle" perform the equivalent pressure reduction absorption, the bottle evaluated as the case denoted by the sign "double circles" can obtain the target absorption volume at a lower degree of pressure reduction, and therefore the movable wall portion thereof can rapidly move.

Based on the reference signs "h1", "L1", "S1", "L2" and "S2" shown in FIGS. 2 and 3, FIG. 4 shows the dimensional settings of the experimental examples, and FIG. 5 shows the results of the experimental examples.

The item "shape diagram" is shown in the uppermost row (first row) of the second column in each table shown in FIGS. 4 and 5, and various parameters of dimensional settings of flat bottles in the experimental examples are shown in the uppermost row of the third column and subsequent columns of FIG. 4. In addition, degrees of pressure reduction, the absorption volumes, and the results of visual tests are shown in the third column and subsequent columns of FIG. 5, as the experimental results corresponding to the experimental examples of FIG. 4.

Schematic shapes and specific values of the experimental examples, and the experimental results are shown in the second row and subsequent rows of each column (the second column and subsequent columns) of FIGS. 4 and 5. Hereinafter, the tables shown in FIGS. 4 and 5 may be referred to as "each table".

The weight of bottom portion in each experimental example was set to 2.9 g. The weight of bottom portion means the weight of the grounding portion and the internal portions thereof in the radial direction in the bottom wall portion of the bottom portion described in the above embodiment. That is, the weight of the bottom portion corresponds to the weight of the grounding portion, the rising circumferential wall portion, the movable wall portion, the recessed circumferential wall portion and the top wall.

(Experimental Examples Under L1:S1=1.2:1, h1=2.75 mm)

The dimensions and experimental results of two experimental examples are shown in the second and third rows of each table, wherein the ratio of the length of a flat bottle along the major axis of the bottom portion (L1=75 mm) to the length of the flat bottle along the minor axis of the bottom portion (S1=62.5 mm) is 1.2:1, the height dimension h1 is 2.75 mm, and L2/S2 is 0.8 or 1.0.

In addition, in the two experimental examples, the ratio of the movable wall portion to the bottom portion in the major axis direction (2L2/L1) is 0.4, and the ratio in the minor axis direction (2S2/S1) is 0.5. These two experimental examples are included in the range of the dimensional settings of the present invention.

In the two experimental examples, the movable wall portion smoothly moved visually. Therefore, the visual tests were evaluated as the case denoted by the sign "double circles", and the present invention was confirmed to be effective.

(Experimental Examples Under L1:S1=1.41:1, h1=2 mm)

The dimensions and experimental results of experimental examples are shown in the fourth to twelfth rows of each table, wherein the ratio of the length of a flat bottle along the major axis of the bottom portion (L1=82 mm) to the length of the flat bottle along the minor axis of the bottom portion (S1=58.1 mm) is 1.41:1, and the height dimension h1 is 2 mm. Additionally, in the experimental examples, L2/S2 is set in 0.3 to 2.5.

The experimental example in which L2/S2 is 0.3 is shown in the fourth row, and this experimental example deviates from the dimensional settings of the present invention. In this example, although the movable wall portion moved to the horizontal position visually, the deformation of the top part of the recessed circumferential wall portion was significant, and the movement of the movable wall portion was not smooth, and thus, the visual test was evaluated as the case denoted by the sign "single circle". In addition, at the time the movable wall portion reached the horizontal position, the degree of pressure reduction was 9.5 kPa, and the absorption volume was 5.9 ml.

The settings in which L2/S2 is 1.0 to 2.5 are shown in the fifth to twelfth rows, and these experimental examples are included in the range of the dimensional settings of the present invention. In these examples, most of the movable wall portions smoothly moved to the horizontal position visually, and thus, most of the visual tests were evaluated as the case denoted by the sign "double circles".

According to the above results, if the dimensional settings in which L2/S2 is 1.0 to 2.5 are employed, since it can be evaluated that the movable wall portion smoothly moves, the present invention is confirmed to be effective.

In contrast, it is conceivable that the movable wall portion did not smoothly move under the settings of L2/S2 being 0.3 in the experimental example of the fourth row, because the length of the movable wall portion along the major axis was small and thereby the rigidity of the part of the movable wall portion along the major axis extremely increased. In addition, it is conceivable that the size of the movable wall portion decreases and in contrast the size of the recessed circumferential wall portion increases in the major axis direction, a large amount of force is required to move the movable wall portion, the movable wall portion cannot move unless the degree of pressure reduction is increased, and therefore, the degree of pressure reduction increases.

Furthermore, in the settings in which L2/S2 is 1.0 to 2.5, if this ratio increases, the degree of pressure reduction and the absorption volume increase. If considering the results, in the range in which L2/S2 is 1.0 to 2.5, it is apparent that if this ratio is set to be smaller, the movable wall portion can more rapidly move, and the pressure reduction-absorbing property by the movable wall portion can be further improved. In addition, between the ratios of 1.2 and 1.3, the degree of pressure reduction increases from 3.8 to 5.0, and that is, although a change in the ratio is small, the degree of pressure reduction sharply increases. According to the results, it is preferable that the ratio of L2/S2 be 1.2 or less. That is, it can be evaluated that if the degree of pressure reduction is lower, the movable wall portion more smoothly moves, and if the ratio is 1.2, stress is uniformly applied to the entire movable wall portion, and the entire movable wall portion uniformly and smoothly moves.

The experimental examples in which L2/S2 is set to 1.0 are shown in the fifth, eleventh and twelfth rows of each table, and the settings of the fifth row were evaluated as the case denoted by the sign "double circles", whereas the settings of the eleventh and twelfth rows were evaluated as the case denoted by the sign "single circle".

If considering this difference, in the settings of the fifth row evaluated as the case denoted by the sign "double circles", the ratio of the movable wall portion to the bottom portion in the major axis direction (2L2/L1) is 0.4, and the ratio in the minor axis direction (2S2/S1) is 0.6.

On the other hand, in the settings of the eleventh row evaluated as the case denoted by the sign "single circle", the ratio of the movable wall portion to the bottom portion in the major axis direction (2L2/L1) is 0.3, and the ratio in the minor axis direction (2S2/S1) is 0.4.

In addition, in the settings of the twelfth row evaluated as the case denoted by the sign "single circle", the ratio of the movable wall portion to the bottom portion in the major axis direction (2L2/L1) is 0.1, and the ratio in the minor axis direction (2S2/S1) is 0.2.

According to the results, if each of the ratios of the lengths of the movable wall portion to the lengths of the bottom portion, i.e., 2L2/L1 (in the major axis direction) and 2S2/S1 (in the minor axis direction), is 0.4 or more, it is possible to smoothly move the movable wall portion. It is conceivable that this is because the entire movable wall portion obtains suitable flexibility. That is, it is conceivable that the movable wall portions of the experimental examples of the eleventh and twelfth rows are smaller than that of the experimental example of the fifth row (the recessed circumferential wall portions of the eleventh and twelfth rows are larger than that of the fifth row), larger force is required for moving the movable wall portion, the movable wall portion cannot smoothly move, and thus, the degree of pressure reduction increases.

In addition, it is preferable that each of the ratios of the lengths of the movable wall portion to the lengths of the bottom portion, i.e., 2L2/L1 (in the major axis direction) and 2S2/S1 (in the minor axis direction), be 0.4 to 0.8. This is because if the ratio exceeds 0.8, since the movable wall portion becomes extremely large and the recessed circumferential wall portion becomes small, problems may occur in the formability, and it may be difficult to design molding apparatuses.

(Experimental Examples Under L1:S1=1.41:1, h1=2.75 mm)

The dimensions and experimental results of experimental examples are shown in the thirteenth to twenty-first rows of each table, wherein the ratio of the length of a flat bottle along the major axis of the bottom portion (L1=82 mm) to the length of the flat bottle along the minor axis of the bottom portion (S1=58.1 mm) is 1.41:1, and the height dimension h1 is 2.75 mm. Additionally, in the experimental examples, L2/S2 is set in 0.3 to 5.0.

The experimental example in which L2/S2 is 0.3 is shown in the thirteenth row, and this experimental example deviates from the dimensional settings of the present invention. In this example, although the movable wall portion moved to the horizontal position visually, the deformation of the top part of the recessed circumferential wall portion was significant, the movement of the movable wall portion was not smooth, and thus, the visual test was evaluated as the case denoted by the sign "single circle". In addition, at the time the movable wall portion reached the horizontal position, the degree of pressure reduction was 41.6 kPa, and the absorption volume was 12 ml. The movable wall portion did not move unless the degree of pressure reduction was made to be extremely high, and the absorption volume was large at the time the movable wall portion reached the horizontal position. It is conceivable that this is because the pressure reduction absorption was mainly performed by the top part of the recessed circumferential wall portion (large deformation of the top part). As a result, if L2/S2 is 0.3, the pressure reduction-absorbing property was not properly obtained by the movable wall portion.

The experimental example in which L2/S2 is 0.7 is shown in the fourteenth row, and this experimental example deviates from the dimensional settings of the present invention. In this example, the movable wall portion did not move to the horizontal position visually, and the visual test was evaluated as the case denoted by the sign "x-mark".

The settings in which L2/S2 is 1.0 to 5.0 are shown in the fifteenth to twenty-first rows.

In the experimental examples having the above settings, the settings shown in the fifteenth to seventeenth rows and in the twentieth to twenty-first rows are included in the range of the dimensional settings of the present invention. On the other hand, the settings of the eighteenth to nineteenth rows are not included in the range of the dimensional settings of the present invention.

The settings in which L2/S2 is 1.0, 1.7 or 2.5 are shown in the fifteenth, sixteenth or seventeenth row, respectively. In these examples, the movable wall portion smoothly moved to the horizontal position visually, and thus the visual tests were evaluated as the case denoted by the sign "double circles". Therefore, the present invention is confirmed to be effective.

In addition, the settings in which L2/S2 is 4.8 or 5.0 are shown in the eighteenth or nineteenth row, respectively. In these examples, the movable wall portion did not move to the horizontal position visually, and the visual tests were evaluated as the case denoted by the sign "x-mark". Therefore, it is apparent that if L2/S2 is extremely large, the pressure reduction-absorbing property cannot be properly obtained by the movable wall portion. It is conceivable that this is because stress due to pressure reduction is extremely concentrated on part of the movable wall portion along the minor axis, the stress is not spread on part of the movable wall portion along the major axis, and it becomes difficult to turn and deform the movable wall portion.

The settings in which L2/S2 is 1.0 are shown in the twentieth to twenty-first rows. Although the movable wall portion moved to the horizontal position visually, the deformation of the top part of the recessed circumferential wall portion was large, the movement of the movable wall portion was not smooth, and thus, the visual tests were evaluated as the case denoted by the sign "single circle".

In the settings of the twentieth row evaluated as the case denoted by the sign "single circle", the ratio of the movable wall portion to the bottom portion in the major axis direction (2L2/L1) is 0.3, and the ratio in the minor axis direction (2S2/S1) is 0.4. In the settings of the twenty-first row evaluated as the case denoted by the sign "single circle", the ratio of the movable wall portion to the bottom portion in the major axis direction (2L2/L1) is 0.1, and the ratio in the minor axis direction (2S2/S1) is 0.2.

It is conceivable that since 2L2/L1 (in the major axis direction) or 2S2/S1 (in the minor axis direction) in the settings of the twentieth and twenty-first rows did not satisfy the condition of 0.4 or more as described above, the movable wall portion did not smoothly move.

According to the above results, if each of the ratios of the lengths of the movable wall portion to the lengths of the bottom portion, i.e., 2L2/L1 (in the major axis direction) and 2S2/S1 (in the minor axis direction), is 0.4 or more, it is possible to smoothly move the movable wall portion.

(Experimental Examples Shown in the Twenty-Second to Twenty-Fourth Rows)

All these experimental examples deviate from the dimensional settings according to the present invention. In addition, L1 is 97.6 mm, and S1 is 48.8 mm. In these experimental examples, the movable wall portion did not move to the horizontal position visually, and the visual tests were evaluated as the case denoted by the sign "x-mark".

(Consideration)

In the above experimental examples, it is estimated that if the length of the movable wall portion along the major axis is 0.8 to 1.2 times the length of the movable wall portion along the minor axis, stress is uniformly applied to part of the movable wall portion along the major axis and to part of the movable wall portion along the minor axis, and it becomes easy to uniformly turn the entire movable wall portion.

In addition, it is estimated that even in a case where the length of the movable wall portion along the major axis exceeds 1.2 times the length of the movable wall portion along the minor axis, if the length of the movable wall portion along the major axis is 2.5 times or less of the length of the movable wall portion along the minor axis, although it may not be easy to turn and deform the movable wall portion compared to a case where the length of the movable wall portion along the major axis is 0.8 to 1.2 times the length of the movable wall portion along the minor axis, the movable wall portion can approximately uniformly turn and be deformed.

In contrast, it is apparent that if the length of the movable wall portion along the major axis exceeds 2.5 times the length of the movable wall portion along the minor axis, the turning deformation of the movable wall portion is scarcely performed.

Accordingly, if the length of the movable wall portion along the major axis is 0.8 to 2.5 times the length of the movable wall portion along the minor axis, it is possible to properly obtain the pressure reduction absorption by the movable wall portion.

In a flat bottle, if the ratio of the length of the movable wall portion along the major axis to the length of the bottom portion along the major axis is 0.4 or more and the ratio of the length of the movable wall portion along the minor axis to the length of the bottom portion along the minor axis is 0.4 or more, the movable wall portion can have the sufficient flexibility (the rigidity thereof can be prevented from extremely increasing), compared to a case where the ratio of the length of the movable wall portion along the major axis to the length of the bottom portion along the major axis is less than 0.4 or where the ratio of the length of the movable wall portion along the minor axis to the length of the bottom portion along the minor axis is less than 0.4. Therefore, it becomes easy to smoothly turn the movable wall portion, the pressure reduction absorption can be obtained by the movable wall portion, and the deformation of the body portion or the like can be suppressed.

INDUSTRIAL APPLICABILITY

The present invention can be applied to a flat bottle having a flattened shape in lateral cross-section.

DESCRIPTION OF REFERENCE SIGNS

1 flat bottle
13 body portion
14 bottom portion
18 grounding portion
19 bottom wall portion
21 rising circumferential wall portion
22 movable wall portion
22*a* outer end
22*b* inner end
23 recessed circumferential wall portion
25 curved surface part (connected portion)
O bottle axis
La major axis
Sa minor axis

The invention claimed is:

1. A flat bottle comprising a cylindrical body portion and a bottom portion which closes a lower opening section of the body portion, and the flat bottle having a flattened shape in lateral cross-section which has a major axis and a minor axis perpendicular to each other at a point on a bottle axis, wherein a bottom wall portion of the bottom portion comprises:

a grounding portion positioned at an outer circumferential edge of the bottom wall portion;

a rising circumferential wall portion connected to an inside of the grounding portion in a bottle radial direction and extending upward;

an annular movable wall portion projecting from an upper end part of the rising circumferential wall portion toward inside of the rising circumferential wall portion in the bottle radial direction; and a recessed circumferential wall portion extending upward from an inner end of the movable wall portion in the bottle radial direction, wherein the movable wall portion is arranged to be movable around a connected portion between the movable wall portion and the rising circumferential wall portion so as to move the recessed circumferential wall portion upward, a length of the bottom portion in a major axis direction parallel to major axis is 1.2 to 2.0 times a length of the bottom portion in a minor axis direction parallel to the minor axis, and a first length is 0.8 to 2.5 times a second length, the first length being a length obtained by subtracting a length between two ends of the recessed circumferential wall portion in the major axis direction from a length between two ends of the movable wall portion in the major axis direction, and the second length being a length obtained by subtracting a length between two ends of the recessed circumferential wall portion in the minor axis direction from a length between two ends of the movable wall portion in the minor axis direction.

2. The flat bottle according to claim 1, wherein the movable wall portion is provided sloping gradually downward as it approaches inward from outside of the movable wall portion in the bottle radial direction, and a distance in a bottle axial direction between an outer end and the inner end of the movable wall portion in the bottle radial direction is 1 to 3 mm.

3. The flat bottle according to claim 1, wherein a ratio of the first length to the length of the bottom portion in the major axis direction is 0.4 or more, and a ratio of the second length to the length of the bottom portion in the minor axis direction is 0.4 or more.

4. The flat bottle according to claim 2, wherein a ratio of the first length to the length of the bottom portion in the major axis direction is 0.4 or more, and a ratio of the second length to the length of the bottom portion in the minor axis direction is 0.4 or more.

* * * * *